US009067607B2

(12) United States Patent
Donnelly, III

(10) Patent No.: US 9,067,607 B2
(45) Date of Patent: Jun. 30, 2015

(54) COMMUNICATION SYSTEM FOR MULTIPLE LOCOMOTIVES

(71) Applicant: Electro-Motive Diesel, Inc., LaGrange, IL (US)

(72) Inventor: William Joseph Donnelly, III, Shorewood, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 191 days.

(21) Appl. No.: 13/665,319

(22) Filed: Oct. 31, 2012

(65) Prior Publication Data

US 2014/0117167 A1 May 1, 2014

(51) Int. Cl.

| | |
|---|---|
| ***B61L 3/00*** | (2006.01) |
| ***B61C 17/12*** | (2006.01) |
| ***B61L 15/00*** | (2006.01) |

(52) U.S. Cl.

CPC ..... *B61L 3/006* (2013.01); *B61C 17/12* (2013.01); *B61L 15/0036* (2013.01)

(58) Field of Classification Search

USPC ..... 105/26.05, 34.1, 34.2, 49, 62.1; 246/167 R, 182 R, 182 C, 186, 187 R

See application file for complete search history.

(56) References Cited

U.S. PATENT DOCUMENTS

| | | | | |
|---|---|---|---|---|
| 4,344,364 | A * | 8/1982 | Nickles et al. | 105/62.1 |
| 4,360,873 | A | 11/1982 | Wilde et al. | |
| 4,401,035 | A | 8/1983 | Spigarelli et al. | |
| 4,602,335 | A | 7/1986 | Perlmutter | |
| 6,937,925 | B2 | 8/2005 | Smith | |
| 7,021,588 | B2 | 4/2006 | Hess, Jr. et al. | |
| 7,618,011 | B2 | 11/2009 | Oleski et al. | |
| 7,680,566 | B2 | 3/2010 | Liberatore | |
| 7,906,862 | B2 | 3/2011 | Donnelly | |
| 8,095,253 | B2 | 1/2012 | Kane et al. | |

FOREIGN PATENT DOCUMENTS

| | | |
|---|---|---|
| JP | 3557952 | 8/2004 |

* cited by examiner

*Primary Examiner* — R. J. McCarry, Jr.

(57) ABSTRACT

The disclosure is directed to a control system for a train consist. The control system may have a first controller associated with a first locomotive and a second controller associated with a second locomotive. The control system may also include an input device configured to generate a first signal indicative of a desired consist performance, and at least one sensor configured to generate a second signal indicative of an actual performance of the first and second locomotives. The second controller may be configured to determine a first performance setting of the first locomotive and a different second performance setting of the second locomotive based on the first signal, and automatically adjust the first and second performance settings based on a difference between the first and second signals.

17 Claims, 2 Drawing Sheets

COMMUNICATION SYSTEM FOR MULTIPLE LOCOMOTIVES

TECHNICAL FIELD

The present disclosure relates generally to a control system and, more particularly, to a control system for multiple locomotives.

BACKGROUND

A train consist often includes a lead locomotive and at least one trailing locomotive. The lead locomotive, although generally located at the leading end of the consist, can alternatively be located at any other position along its length. The locomotives provide power to the rest of the consist, and the lead locomotive generates operator and/or autonomous control commands directed to components of the lead and trailing locomotives.

Communication between the lead and trailing locomotives can involve a hardwired multi unit (MU) cable, which signals a desired power level for the consist. The MU cable includes several wires (usually five) to indicate different notch settings (predefined power levels), and two additional wires to indicate a variable load control. Most of these wires are binary indicators that either provide a voltage or no voltage to the wires. Although functional, this control system is inefficient because of its limited communication abilities.

One attempt to improve communication between locomotives in a consist is disclosed in U.S. Pat. No. 7,021,588 that issued to Hess, Jr. et al. on Apr. 4, 2006 ("the '588 patent"). In particular, the '588 patent describes a method for controlling a consist of at least first and second locomotives having discrete operating modes. The method comprises receiving a control command and determining a power operating mode of the first locomotive and a power operating mode of the second locomotive as a function of the control command and an optimization parameter.

Although the system of the '588 patent may have improved communication between multiple locomotives in a consist, the system may still be problematic. In particular, the system may be limited to identifying a desired operating mode based on the control command. Accordingly, the system may be unable to automatically adjust the operating mode (e.g., notch setting) in the event that the consist has not reached or is unable to reach a desired performance. For example, if the consist was operating below a desired power output at the identified notch setting, the system would be unable to make adjustments necessary to reach the desired power output.

The control system of the present disclosure solves one or more of the problems set forth above and/or other problems in the art.

SUMMARY

In one aspect, the disclosure is directed to a control system for a train consist. The control system may have a first controller associated with a first locomotive and a second controller associated with a second locomotive. The control system may also include an input device configured to generate a first signal indicative of a desired consist performance, and at least one sensor configured to generate a second signal indicative of an actual performance of the first and second locomotives. The second controller may be configured to determine a first performance setting of the first locomotive and a different second performance setting of the second locomotive based on the first signal, and automatically adjust the first and second performance settings based on a difference between the first and second signals.

In another aspect, the disclosure is directed to a method of controlling a train consist. The method may include receiving a desired consist performance from an input device and determining a first performance setting of a first locomotive and a different second performance setting of a second locomotive based on the desired consist performance. The method may further include monitoring an actual performance of the first and second locomotives and automatically adjusting the first and second performance settings based on a difference between the desired consist performance and the actual performance of the first and second locomotives.

DETAILED DESCRIPTION

Figure 1:
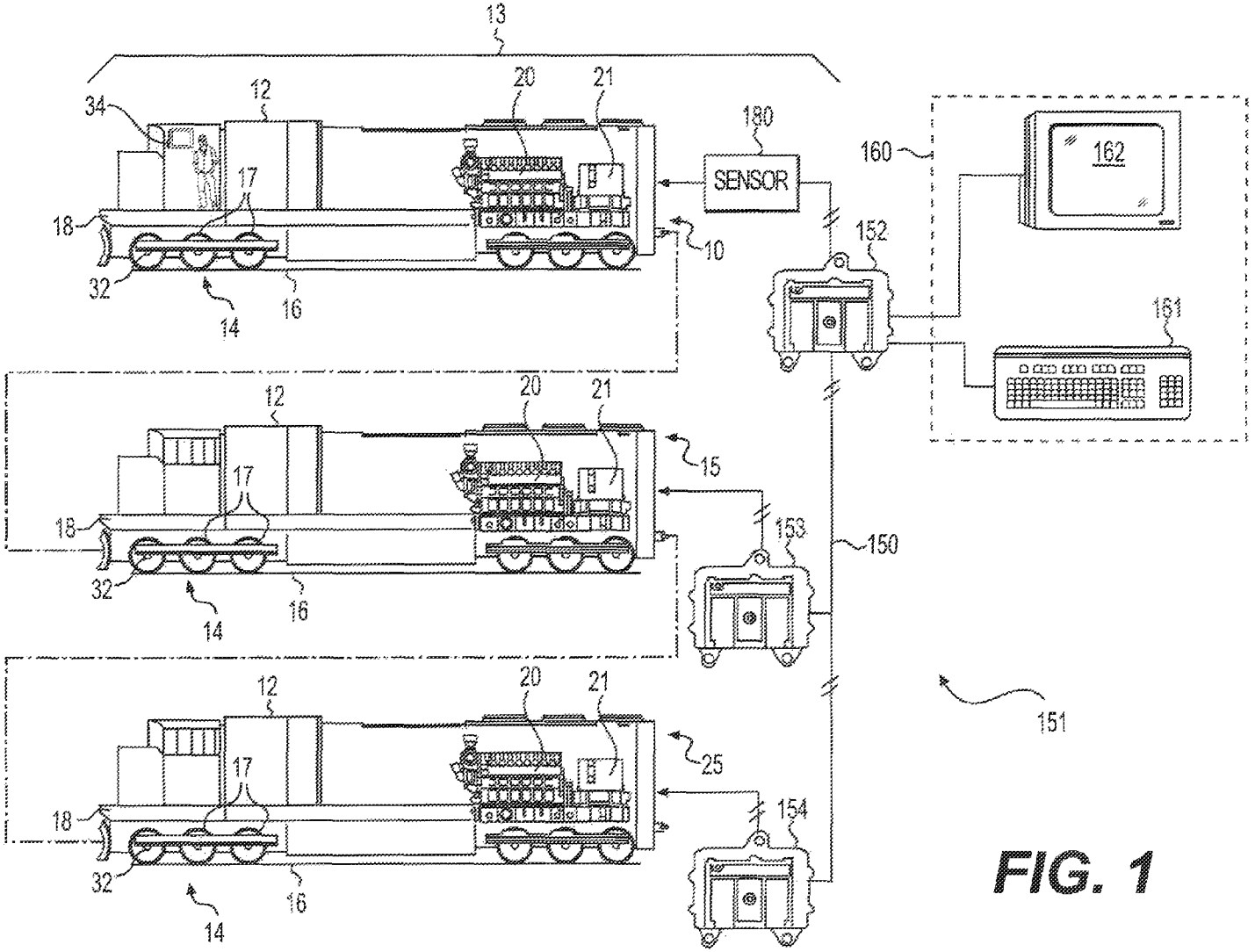
FIG. 1 is a pictorial and diagrammatic illustration of an exemplary disclosed train consist and control system.

FIG. 1 illustrates an exemplary disclosed train consist 13 having a lead locomotive 10 and one or more trailing locomotives 15, 25 operatively coupled to lead locomotive 10. In some embodiments, additional cars may be included within consist 13 and towed by lead locomotive 10 and trailing locomotives 15, 25, for example, a passenger car (not shown), a cargo container car (not shown), or another type of car. It should be noted that, while a particular order of cars in consist 13 is shown in FIG. 1 and described above, a different order may be implemented as desired. For example, trailing locomotive 15 could be situated in front of lead locomotive 10.

Lead locomotive 10 may include a car body 12 supported at opposing ends by a plurality of trucks 14 (e.g., two trucks 14). Each truck 14 may be configured to engage a track 16 via a plurality of wheels 17, and support a frame 18 of car body 12. Any number of engines 20 may be mounted to frame 18 and configured to drive a generator 21 to produce electricity that propels wheels 17 of lead locomotive 10. In the exemplary embodiment shown in FIG. 1, lead locomotive 10 includes one engine 20 and one generator 21.

Engine 20 may be a large engine, for example an engine having sixteen cylinders and a rated power output of about 4,000 brake horsepower (bhp). Engine 20 may be configured to combust a gaseous fuel, such as natural gas, and generate a mechanical output that drives generator 21 to produce electric power. The electric power from generator 21 may be used to propel lead locomotive 10 via one or more traction motors 32 associated with wheels 17. It should be noted that engine 20 may have a different number of cylinders, a different rated power output, and/or be capable of combusting another type of fuel, if desired.

Generator 21 may be an induction generator, a permanent-magnet generator, a synchronous generator, or a switched-reluctance. In one embodiment, generator 21 may include multiple pairings of poles (not shown), each pairing having three phases arranged on a circumference of a stator (not shown) to produce an alternating current.

Traction motors 32, in addition to providing the propelling force of lead locomotive 10 when supplied with electric power, may also function to slow lead locomotive 10. This process is known in the art as dynamic braking. When a traction motor 32 is not needed to provide motivating force, it can be reconfigured to operate as a generator. As such, traction motors 32 may convert the kinetic energy of lead locomotive 10 into electric power, which has the effect of slowing lead locomotive 10. The electric power generated during dynamic braking is typically transferred to one or more resistance grids (not shown) mounted on car body 12. At the resistance grids, the electric power generated during dynamic braking is converted to heat and dissipated into the atmosphere. Alternatively or additionally, electric power generated from dynamic braking may be routed to an energy storage system (not shown) and used to selectively provide supplemental power to traction motors 32.

Lead locomotive 10 may also include a cabin 34 supported by frame 18, Cabin 34 may be an onboard location from which an operator observes performance of lead locomotive 10 and consist 13, and provides instructions for controlling engine 20, generator 21, motors 32, brakes (not shown), and other components of consist 13. In the disclosed embodiment, cabin 34 is a substantially enclosed structure located at a leading end of lead locomotive 10.

For the purposes of this disclosure, trailing locomotives 15, 25 may be considered to be self-powered mobile train cars having the same general components as lead locomotive 10. For example, trailing locomotives 15, 25 in the exemplary embodiment include car bodies 12, trucks 14, wheels 17, frames 18, engines 20, generators 21, and traction motors 32. It is contemplated that these components of trailing locomotives 15, 25 may be substantially identical to the corresponding components of lead locomotive 10 or, alternatively, have a different configuration, as desired. For example, the engine 20 of trailing locomotives 15, 25 may have a reduced output as compared to the engine 20 of lead locomotive 10. Similarly, the traction motors 32 of trailing locomotives 15, 25 could have a greater or lesser torque and/or speed. capacity compared to the traction motors 32 of lead locomotive 10. Also, in contrast to lead locomotive 10, trailing locomotives 15, 25 may not be provided with a cabin 34, in some embodiments.

In some embodiments, trailing locomotive 25 may be substantially different from lead locomotive 10 and trailing locomotive 15. Trailing locomotive 25 may have a different manufacturer, model number, and/or manufacture date than lead locomotive 10 and trailing locomotive 15, which may hinder communication abilities. For example, trailing locomotive 25 may be a General Electric (GE) locomotive, while lead locomotive 10 and trailing locomotive 15 may be Electro-Motive Diesel (EMD) locomotives. However, consist control system 151 of this disclosure may allow proper communication between lead locomotive 10, trailing locomotive 15, and trailing locomotive 25, via a communication link 150.

Communication link 150 may be capable of transmitting data and controlling signals from lead locomotive 10 to trailing locomotives 15, 25. It is contemplated that communication link 150 may embody a hard-wired multi-unit (MU) cable or any existing form of communication between multiple locomotives known to the art. Communication link 150 may alternatively embody, for example, a wireless communication link capable of sending and receiving data from lead locomotive 10 or an offboard data system (not shown).

In addition to communication link 150, the control system 151 may include a master controller 152, one or more secondary controllers 153, 154, and an input device 160. Master controller 152 may be located onboard lead locomotive 10 and may be configured to monitor and control operation of lead locomotive 10 (e.g. regulate tractive forces), as well as regulate one or more secondary controllers 153, 154 through communication link 150.

Master controller 152 may embody a single microprocessor or multiple microprocessors that include mechanisms for controlling lead locomotive 10 based on, among other things, input from an operator and/or one or more sensed operational parameters. Numerous commercially available microprocessors can be configured to perform the functions of master controller 152. It should be appreciated that master controller 152 could readily embody a general machine system microprocessor capable of controlling numerous machine system functions and modes of operation. Various other known circuits may be associated with master controller 152, including power supply circuitry, signal-conditioning circuitry, solenoid driver circuitry, communication circuitry, and other appropriate circuitry. It is contemplated that master controller 152 may also be located offboard lead locomotive 10 and may control consist 13 through any form of wireless communication known to the art.

Secondary controllers 153, 154 may be in communication with master controller 152 and may be configured to receive signals from master controller 152 to control operation of trailing locomotives 15, 25, respectively. In sonic embodiments, secondary controllers 153, 154 may also be capable of controlling the same machine system functions and modes of operation as master controller 152. It is contemplated, however, that in other embodiments, secondary controller 154 may be substantially different from master controller 152 and secondary controller 153. In these embodiments, secondary controller 154 may not be capable of controlling the same machine system functions and modes of operation as master controller 152 and secondary controller 153. Accordingly, master controller 152 may be further configured to store data and information about trailing locomotive 25 in a memory device to assist communication with secondary controller 154 located onboard trailing locomotive 25. Master controller 152 may also be configured to use this data and information to selectively override system functions and modes of operation of trailing locomotive 25 based on the knowledge of trailing locomotive 25 contained within master controller 152.

Input device 160 may be located onboard lead locomotive 10 and may include any component or components configured to transmit signals to one or more components of consist 13 (e.g. master controller 152). In some embodiments, input device 160 may include components that an operator can manipulate to indicate whether the operator desires propulsion of consist 13 by traction motors 32 and, if so, in what direction and with how much power the operator desires traction motors 32 to propel consist 13. For example, input device 160 may include an operator input device 161 with which an operator may indicate a desired consist performance to be received by master controller 152. In alternative embodiments, input device 160 may be a computer based system that may allow consist 13 to operate automatically without requiring an operator.

Operator input device 161 may be a keyboard, touchpad, throttle, or other suitable mechanism for receiving operator input. The operator may use operator input device 161 to manually adjust various parameters of consist 13. Operator input device 161 may transmit a signal to master controller 152 indicating the desired consist performance of consist 13. Master controller 152 may then be configured to communicate the desired consist performance through communication link 150 to secondary controllers 153, 154. Additionally, input device 160 may include a display 162 in communication with master controller 152. Display 162 may be any known display mechanism and may visually output various information useful to an operator of consist 13.

To facilitate effective control of the supply of electricity from generator 21 to traction motors 32, master controller 152 and secondary controllers 153, 154 may monitor various aspects of engine operation, generator operation, traction motor operation, and/or transmission of electricity within the system. For example, master controller 152 and secondary controllers 153, 154 may monitor engine speed, engine fueling, and/or engine load of their respective engines 20. Likewise, master controller 152 and secondary controllers 153, 154 may monitor the voltage, current, frequency, and/or phase of electricity generated by their respective generators 21. Additionally, master controller 152 and secondary controllers 153, 154 may monitor the electricity supplied to and/or consumed by traction motors 32, a torque output of traction motors 32, and/or tractive forces of locomotives 10, 15, 25. Master controller 152 and secondary controllers 153, 154 may also employ sensors and/or other suitable mechanisms to monitor the operating parameters. For example, master controller 152 may monitor an actual performance of consist 13 with one or more sensor(s) 180.

Figure 2:
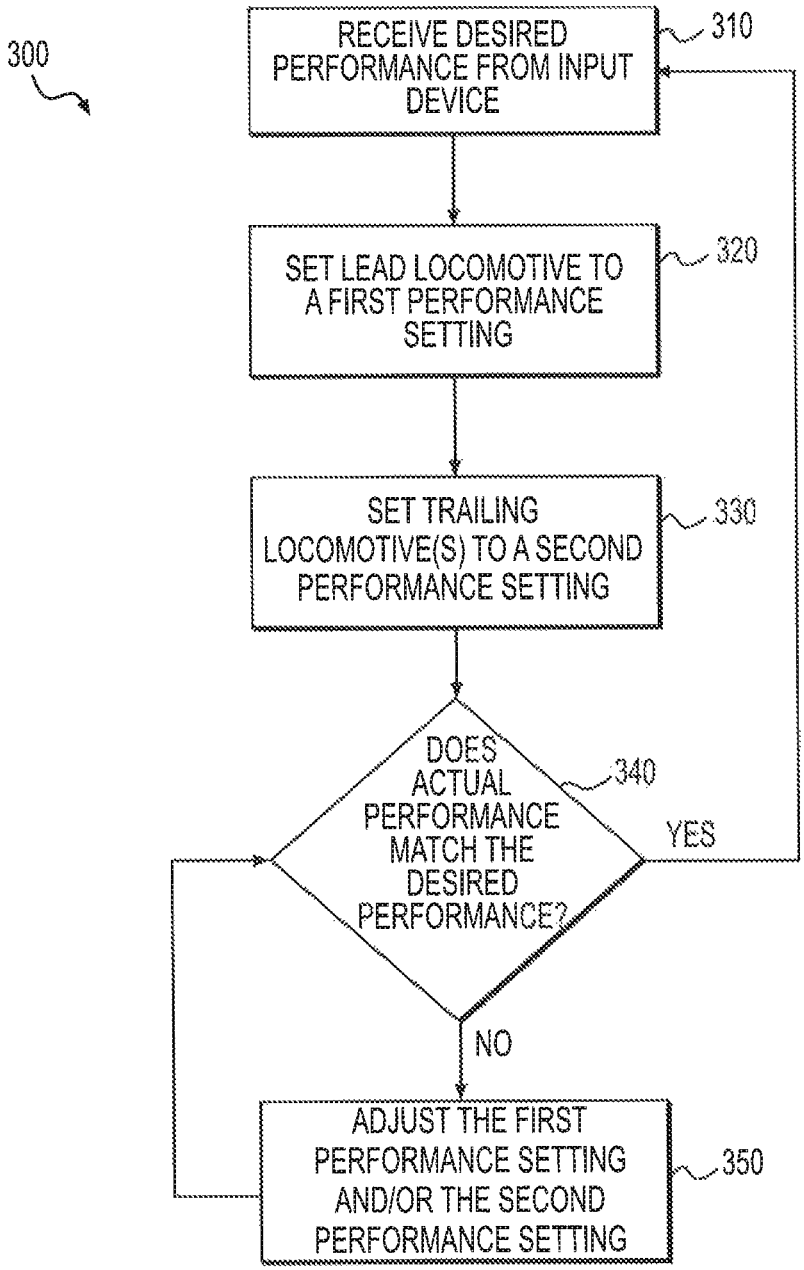
FIG. 2 is a flowchart depicting an exemplary disclosed method performed by the control system of FIG. 1.

FIG. 2 illustrates an exemplary operation of consist 13 performed by the disclosed control system 151. FIG. 2. will be discussed in more detail below.

Industrial Applicability

The disclosed consist control system may be used with any rail or non-rail transportation system where a reliable, accurate, durable and secure means of transmitting power, command controls, and data signals along a consist is desired. It is contemplated that the presently disclosed consist control system may be utilized with any number of vehicles and/or different types of vehicles in various arrangements. For example, consist 13 could include additional locomotives, passenger cars, freight cars, tanker cars, etc. Additionally, it is contemplated that consist 13 may apply to non-rail transportation systems, as desired.

The more locomotives that consist 13 includes, the more important it may be that data, control commands, and power are effectively relayed and maintained along consist 13. Also, it may be desirable to achieve higher communication abilities to obtain higher fuel efficiencies. The disclosed consist control system 151 may include components and methods for accurately achieving a desired performance of consist 13. The operation of consist control system 151 will now be described with reference to FIGS. 1 and 2.

Operation of consist 13 may be automatically monitored and controlled by controllers 152, 153, 154 and/or manually by an operator via input device 160. During operation of consist 13, master controller 152 may communicate and coordinate with secondary controllers 153, 154 and other components of consist 13. Sensors located along consist 13 may alert master controller 152 and/or the consist operator of changes to various physical phenomena at any point along consist 13. Such changes may include changes to speeds, power outputs, temperatures, displacements and/or pressures. Data communication along consist 13 may be accomplished via communication link 150.

There is shown a flowchart 300 in FIG. 2 illustrating a control process according to an exemplary embodiment. Flowchart 300 may begin at Control Block 310, where master controller 152 receives a signal from input device 160 indicating a desired performance of consist 13. The desired consist performance may include a desired power output (e.g. a notch setting corresponding with a discrete range of power output used to propel consist 13), a desired speed, or any other parameters affecting operation of consist 13. The desired consist performance may also include a desired performance of each individual locomotive 10, 15, 25. If the operator has not input a desired consist performance (or the desired consist performance has not otherwise been received or automatically determined), the process may remain at Control Block 310.

Once the desired consist performance has been received, master controller 152 may be configured to determine corresponding performance settings of lead locomotive 10 and trailing locomotives 15, 25 at Control Block 320. For the purposes of this disclosure, the performance settings may include individual power level settings for each of locomotives 10, 15, 25. It is contemplated that the performance settings may also include other parameters affecting operation of locomotives 10, 15, 25. In the disclosed embodiment, the power level settings may control a mechanical power output of each engine 20, an electrical power output of each generator 21, and/or a tractive power output of each set of traction motors 32. These settings may then be applied to engine 20, generator 21, and/or traction motors 32 to vary the overall amount of power used to propel or slow their respective locomotives. In some embodiments, the power level settings may include discrete power levels of engine 20, generator 21, and/or traction motors 32. Once the power level settings have been determined, master controller 152 may then apply the power level settings associated with lead locomotive 10 to its system components. The process may then proceed to Control Block 330.

At Control Block 330, master controller 152 may communicate with secondary controllers 153, 154 of trailing locomotives 15, 25 to signal similar power level settings via communication link 150. The power level settings signaled to trailing locomotives 15, 25 may be substantially different or the same as the power level settings applied to the system components of lead locomotive 10, depending on the configurations of trailing locomotives 15, 25. Master controller 152 may be configured to determine the power level settings for each of trailing locomotives 15, 25 based on fuel efficiency, current traveling conditions, component capacity and configuration, as well as any other factors affecting consist 13. Secondary controllers 153, 154 may communicate with master controller 152 and apply the received power level settings to the system components associated with trailing locomotives 15, 25.

During operation, sensor(s) 180 may be in communication with master controller 152 to generate signals indicating an actual performance of consist 13. Sensors 180 may monitor a number of parameters affecting operation of consist 13, for example, power output, current, voltage, torque, force, speed, etc. In the disclosed embodiment, one or more sensors 180 may monitor individual performances of locomotives 10, 15, 25. At Control Block 340, master controller 152 may receive signals from sensors 180 indicative of the actual performance of each locomotive 10, 15, 25 and combine these individual performances to determine the actual overall consist performance. The actual consist performance may then be compared to the desired consist performance.

If master controller 152 determines that the actual consist performance matches the desired consist performance, the process may return to Control Block 310 to await a further signal from input device 160. However, if master controller 152 determines that there is a difference between the actual consist performance and the desired consist performance, the process may continue to Control Block 350.

At Control Block 350, master controller 152 may adjust the power level settings of lead locomotive 10 and/or trailing locomotives 15, 25 independently to achieve the desired consist performance. The adjustment may include increasing or decreasing the power output of engine 20, generator 21, and/or traction motors 32 of any one or all of locomotives 10, 15, 25. It is contemplated that any combination of lead locomotive 10 and trailing locomotives 15, 25 may be adjusted. The combinations may include adjustments to only lead locomotive 10, one or both of trailing locomotives 15, 25, or all three locomotives 10, 15, 25. Master controller 152 may be configured to determine the corresponding adjustment for each locomotive based on the configuration of each locomotive, overall goals for consist 13 (e.g. fuel efficiency goals), and any other factors affecting consist 13 (e.g. traveling conditions). Secondary controllers 153, 154 may be configured to communicate with master controller 152 and automatically adjust the current power level settings to the adjusted power level settings.

Once the adjustment has been made at Control Block 350, the process may again compare the actual consist performance to the desired consist performance at Control Block 340. If the actual consist performance matches the desired consist performance, the process may return to Control Block 310 and, if not, the process may continue to make further adjustments until the desired consist performance is achieved.

In some embodiments, secondary controller 154 may not be capable of automatically adjusting the power level settings of trailing locomotive 25 because of configuration differences between lead locomotive 10 and trailing locomotive 25. Instead, master controller 152 may be configured to signal an override command to secondary controller 154 and change the power level settings of trailing locomotive 25 based on known configuration differences. By implementing an override command of controller 154, control system 151 may achieve the desired consist performance in situations where lead locomotive 10 and trailing locomotive 25 are substantially different locomotives.

For example, an operator or computer based system may set the notch setting to Notch 6. In one embodiment, this notch setting may correspond to about 3,000 kW. Master controller 152 may communicate individual power level settings for trailing locomotives 15, 25 with secondary controllers 153, 154. Master controller 152 may first set engine 20 of lead locomotive 10 to 80% rated power output. Master controller 152 may then communicate with secondary controllers 153, 154 to set engines 20 of each of trailing locomotives 15, 25 to 40% rated power output. This combination should produce an overall power output of 3,000 kW and still achieve fuel economy and/or life expectancy goals. Master controller 152 and secondary controllers 153, 154 may then apply these power level settings to the engines associated with their respective locomotives. It should be noted that the power level settings may also include, power outputs of generator 21 and traction motors 32.

During operation, sensors 180 may measure the individual power output of locomotives 10, 15, 25. Master controller 152 may communicate with sensors 180 and sum the individual power outputs to determine the overall actual power output of consist 13 is only 2500 kW. To achieve the desired consist power output, master controller 152 and secondary controller 153 may communicate to adjust the power level settings of lead locomotive 10 and/or trailing locomotive 15. For instance, master controller 152 may determine that engine 20 of trailing locomotive 15 should increase its power output and operate at 60% rated power output in order to achieve the desired consist power output. Accordingly, master controller 152 may cause secondary controller 153 to automatically adjust the power level setting of only trailing locomotive 15.

The disclosed control system 151 may allow consist 13 to accurately achieve the desired performance based on a number of additional factors affecting consist 13. The power level settings of locomotives 10, 15, 25 may be adjusted based on variations in engine capacities, generator capacities, traction motor capacities, and existing locomotive control systems. The power level settings may also be adjusted based on current traveling conditions. For instance, the power level settings may be adjusted differently when consist 13 is traveling uphill versus downhill. Additionally, the power level settings may be adjusted differently in order to obtain a desired fuel efficiency from locomotives 10, 15, 25. For example, loads may be shared disproportionately to improve efficiencies of individual engines having different capacities. Master controller 152 may be programmed to include control strategies pertaining to these situations and any other situations that may affect operation and control of consist 13.

It will be apparent to those skilled in the art that various modifications and variations can be made to the disclosed consist control system without departing from the scope of the disclosure. Other embodiments of the consist control system will be apparent to those skilled in the art from consideration of the specification and practice of the consist control system disclosed herein. It is intended that the specification and examples be considered as exemplary only, with a true scope of the disclosure being indicated by the following claims and their equivalents.

What is claimed is:

1. A control system for a train consist, comprising:

a first locomotive;

a second locomotive operatively coupled to the first locomotive;

an input device associated with the first locomotive and configured to generate a first signal indicative of a desired consist performance;

at least one sensor configured to generate a second signal indicative of an actual performance of the first and second locomotives;

a first controller associated with the first locomotive and configured to regulate performance of the first locomotive; and a second controller associated with the second locomotive and in communication with the first controller, the input device, and the at least one sensor, the second controller configured to:

regulate performance of the second locomotive;

determine a first performance setting of the first locomotive and a different second performance setting of the second locomotive based on the first signal;

automatically adjust the first and second performance settings based on a difference between the first and second signals; and override the first controller and adjust the first performance setting based on a known configuration difference between the first and second locomotives.

2. The control system of claim 1, wherein the desired consist performance is an overall desired power output produced by the train consist.

3. The control system of claim 2, wherein the at least one sensor is configured to monitor a power output of the first locomotive and a power output of the second locomotive.

4. The control system of claim 3, further including:

first and second engines disposed on the first and second locomotives;

first and second generators disposed on the first and second locomotives and driven by the first and second engines to produce electric power; and first and second sets of traction motors disposed on the first and second locomotives and driven by the electric power to propel the first and second locomotives in accordance with the first and second performance settings.

5. The control system of claim 4, wherein the first and second performance settings are power outputs associated with at least one of the first and second engines, the first and second generators, and the first and second sets of traction motors.

6. The control system of claim 5, wherein the second controller is configured to adjust the power level settings of only one of the first and second locomotives.

7. The control system of claim 5, wherein the second controller is configured to adjust the power level settings based on at least one of fuel efficiency, current traveling conditions, and component capacity and configuration.

8. A method of controlling a train consist having a first and second locomotive, the method comprising:

receiving a desired consist performance from an input device;

determining a first performance setting of the first locomotive and a different second performance setting of the second locomotive based on the desired consist performance;

monitoring an actual performance of the first and second locomotives;

comparing the desired consist performance and the actual performance of the first and second locomotives;

automatically adjusting the first and second performance settings based on a difference between the desired consist performance and the actual performance of the first and second locomotives; and overriding a controller to adjust the first performance setting based on a known configuration difference between the first and second locomotives.

9. The method of claim 8, wherein adjusting the first and second performance settings includes adjusting power output associated with at least one of an engine, a generator, and a set of traction motors.

10. The method of claim 8, wherein monitoring the actual performance includes measuring a power output of the first and second locomotives.

11. The method of claim 8, further including adjusting the first and second performance settings based on at least one of fuel efficiency, current traveling conditions, and component capacity and configuration.

12. A train consist, comprising:

a first locomotive;

a second locomotive operatively coupled to the first locomotive;

first and second engines disposed on the first and second locomotives;

first and second generators disposed on the first and second locomotives and driven by the first and second engines to produce electric power;

first and second sets of traction motors disposed on the first and second locomotives and driven by the electric power to propel the first and second locomotives;

an input device associated with the first locomotive and configured to generate a first signal indicative of a desired consist performance;

at least one sensor configured to generate a second signal indicative of an actual performance of the first and second locomotives;

a first controller associated with the first locomotive and configured to regulate performance of the first locomotive; and a second controller associated with the second locomotive and in communication with the first controller, the input device, and the at least one sensor, the second controller configured to:

regulate performance of the second locomotive;

determine a first performance setting of the first locomotive and a different second performance setting of the second locomotive based on the first signal;

automatically adjust the first and second performance settings based on a difference between the first and second signals; and override the first controller and adjust the first performance setting based on a known configuration difference between the first and second locomotives.

13. The train consist of claim 12, wherein the desired consist performance is an overall desired power output produced by the train consist.

14. The train consist of claim 13, wherein the at least one sensor is configured to monitor a power output of the first locomotive and a power output of the second locomotive.

15. The train consist of claim 14, wherein the first and second performance settings are power outputs associated with at least one of the first and second engines, the first and second generators, and the first and second sets of traction motors.

16. The train consist of claim 15, wherein the second controller is configured to adjust the power level settings of only one of the first and second locomotives.

17. The train consist of claim 15, wherein the second controller is configured to adjust the power level settings based on at least one of fuel efficiency, current traveling conditions, and component capacity and configuration.

* * * * *